United States Patent [19]

Seeman

[11] Patent Number: 4,662,016

[45] Date of Patent: May 5, 1987

[54] BEDCLOTHES RETAINER

[75] Inventor: Ronald D. Seeman, San Francisco, Calif.

[73] Assignee: Patrica G. Rainey, Santa Rosa, Calif. ; a part interest

[21] Appl. No.: 735,778

[22] Filed: May 20, 1985

[51] Int. Cl.[4] ..... A47C 21/02

[52] U.S. Cl. ..... 5/508; 24/72.5; 5/498

[58] Field of Search ..... 5/494, 496, 508, 498, 5/482; 24/72.5

[56] References Cited

U.S. PATENT DOCUMENTS

| | | | |
|---|---|---|---|
| 420,083 | 1/1890 | McArthur . | |
| 443,742 | 12/1890 | Birdsall . | |
| 852,180 | 4/1907 | Hoffman | 5/498 |
| 1,365,169 | 1/1921 | Goldberg | 24/72.5 |
| 2,223,412 | 12/1940 | Gartz | 24/72.5 |
| 2,459,497 | 1/1949 | Calabro | 5/498 |
| 2,931,084 | 4/1960 | De Witt | 24/72.5 |
| 4,040,133 | 8/1977 | Gilreath | 5/496 |
| 4,199,830 | 4/1980 | Ogata | 5/498 |
| 4,276,667 | 7/1981 | Osbourne | 5/498 |

FOREIGN PATENT DOCUMENTS

| | | | |
|---|---|---|---|
| 733980 | 7/1955 | United Kingdom | 5/498 |

*Primary Examiner*—Alexander Grosz
*Attorney, Agent, or Firm*—David C. Ripma

[57] ABSTRACT

A bedclothes retaining system is provided for holding and positioning bedclothes such as sheets, blankets and other covers on a bed. The retainer includes a plurality of elastic straps which are detachably anchored to the bed by cooperating gripping surfaces; for example, hook and loop tape. A clip or snap fastener is provided at the other end of each strap to attach the strap to the bedclothes. The straps are adjustable in length. Provision is made for the convenient addition of a second strap at each anchor point, if desired.

15 Claims, 4 Drawing Figures

BEDCLOTHES RETAINER

BACKGROUND OF THE INVENTION

This invention relates generally to devices for holding bedclothes or bed coverings in position on a bed.

When a bed is being slept in, bed coverings such as sheets, blankets, spreads and the like have a tendency to move off the side or end of the bed. Devices and systems have been proposed in the past for holding bed coverings, hereinafter referred to as bedclothes, in position on a bed. For example, in U.S. Pat. Nos. 443,742, 852,180 and 1,365,169, strap-type holders are shown in which one end of a strap is looped around a bed rail or frame and the other end is clipped or otherwise attached to the bedclothes. These prior art holders have several disadvantages which make them unsuitable for use with modern beds. One problem with the prior art holders is that the strap must encircle a portion of the bed frame, which was convenient on older open-spring beds but not on modern box spring beds. Another problem is that the straps of the prior art holders, if they are to be hidden from view, must be attached to the bed at inconvenient points.

It would be advantageous to have a bedclothes retaining system which can be used conveniently with modern box spring-type beds. It would also be advantageous to have a bedclothes retaining system in which retaining straps can be easily attached to the bed. It would also be advantageous to have a bedclothes retaining system in which multiple retaining straps can be readily attached to the bed at a single location, thus minimizing tangling and mix-up of the holders. It would be especially advantageous to be able to conveniently add additional holders to a bed as the number and thickness of the bedclothes in use increases.

SUMMARY OF THE INVENTION

Accordingly, a bedclothes retaining system is provided for holding and positioning bedclothes on a bed. The bedclothes retainer comprises a plurality of straps formed of flexible ribbon material which stretches, elastically, in a lengthwise direction. Anchoring means are provided for attaching the plurality of straps to the bed at selected locations. The anchoring means include use of cooperating pieces of gripping material having respective surfaces of first and second types which detachably attach to one another when pressed together. A first piece of the gripping material of one surface type is attached to each strap and a piece of gripping material of the other surface type is provided for attachment to the bed at selected locations. Bedclothes fastener means attached to each strap are provided to securely hold bedclothes. The result is that a plurality of the straps extending between the bedclothes and the anchoring points for the straps will hold and position the bedclothes on a bed.

DETAILED DESCRIPTION OF THE PREFERRED EMBODIMENT

Figure 1:
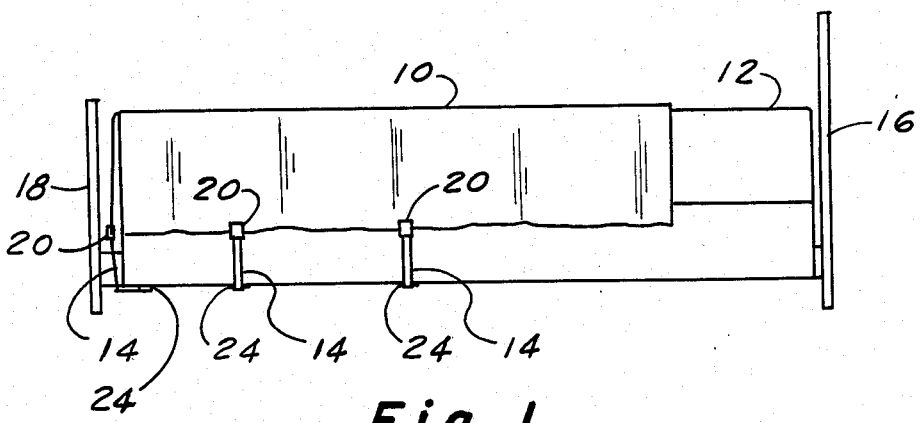
FIG. 1 is a side plan view of the bedclothes retaining means of the present invention in use on a bed.

Referring to FIG. 1, the present invention is a bedclothes retaining means for holding bedclothes 10, such as sheets, blankets, bedspreads, etc., on a bed 12 . The bedclothes retaining means is in the form of a plurality of straps 14 attached to the bed at selected locations. The straps extend between the bed, preferably attached either to the frame or springs, and the bedclothes, where the straps are either clipped or otherwise fastened. The bedclothes retainers hold the bedclothes in position on the bed. As an example of the number of retainers required to retain the bedclothes on a typical double bed, retainers could be located on each side of the bed about midway between the head 16 and the foot 18 of the bed, with a second pair located, one on each side, closer to the foot of the bed, and a third pair along the foot of the bed.

Figure 2:
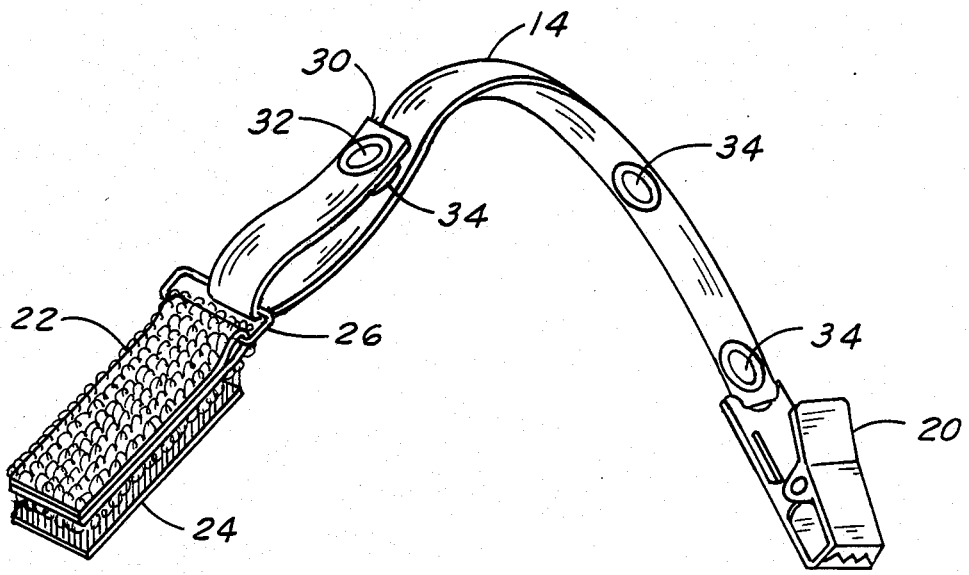
FIG. 2 is an enlarged view of the bedclothes retaining means shown in FIG. 1.

FIG. 2 shows the construction of the individual straps 14. Each strap is preferably formed of a flexible ribbon material which stretches elastically in a lengthwise direction. Elastic stretch material of any conventional type is suitable for straps 14. At one end of each strap is a bedclothes fastener for attaching the strap to the bedclothes. In the embodiment of FIG. 2, the bedclothes fastener is a clip 20 having opposed jaws for gripping the bedclothes. Various types of clips are suitable for this purpose, such as, for example, a spring loaded clip in which the jaws are biased together (as in FIG. 2). One or more layers of bedclothes can be retained by such a clip.

At the other end of the strap is an anchoring means for attaching each of the straps to the bed at a selected location. The anchoring means includes cooperating pieces of gripping material which have respective surfaces of different types which detachably attach to one another when pressed together. The anchoring means is commonly referred to as hook and loop tape or Velcro (trademark). Hook and loop tape comes in two different surface types, covering the respective pieces of gripping material which anchor the straps. A first piece of gripping material 22 of one surface type is attached to the other end of elastic strap 14, opposite to the end where clip 20 is attached. A second piece of gripping material 24, of the opposite surface type, is provided for attachement to the bed at various selected locations. In the illustrated embodiment, anchor piece 24 is of the hook-type, having a surface covered with upright hooks and the piece 22 attached to strap 14 is of the loop-type, having a surface covered with looped nylon strands which are engaged and gripped by the hooks on piece 24. Anchor piece 24 preferably has an adhesive backing for convenient attachment to the bed frame or box springs.

An eyelet 26, attached to strap 14, is provided for attaching hook and loop tape piece 22 to the strap. The hook and loop tape piece 22 is made of a flexible sheet material, covered on one side with the gripping surface. The back side of the hook and loop tape, opposite the gripping surface, is preferably an adhesive. To attach the hook and loop tape to strap 14, the piece 22 is threaded through eyelet 26 and doubled over such that the gripping surface is on the outside, as shown most clearly in cross-section in FIG. 3. As a result, a piece of gripping material formed of flexible sheet material and covered on both sides with a gripping surface is attached along one edge to the end of strap 14.

Strap 14 includes means for adjusting the length of the strap. Such means could include the use of a loop in the strap which passes through eyelet 26. The end 30 of the strap is provided with a snap fastener fitting 32, and cooperating snap fastener fittings 34 are provided at selected locations along the length of strap 14. The term snap fastener, as used herein, refers to a two part fastener, one part having a protruding ball and the cooperating other part having a receiving socket. When pressed together, the two parts snap and are retained by one another. They also can be readily pulled apart. Assuming fastener 32 is a ball-type fitting and the others 34 are sockets, the length of strap 14 can be conveniently adjusted by moving fitting 32 to a different socket 34.

Figure 3:
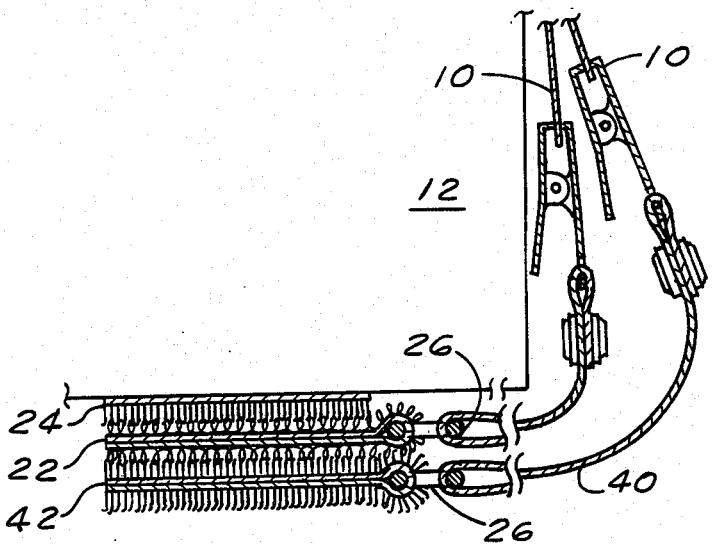
FIG. 3 is a cross-sectional view of the bedclothes retaining means of the present invention, taken along line A—A of FIG. 1, also showing the use of add-on straps.

Use of the bedclothes retainer is simple and convenient. Anchor pieces 24 are attached to the bed frame or box spring, preferably at a point underneath the bed, as shown in FIG. 3. Straps 14 are then attached by simply pressing the gripping pieces 22 against the anchor pieces 24. The straps, properly adjusted for length, are then clipped to the bedclothes. The elastic of straps permits some movement of the bedclothes while the bed is in use. The bedclothes are, nevertheless, retained in place allowing the bed to be made up with ease.

Although several layers of bedclothes can be retained by clips 20, sometimes more than one clip will be required to grasp and hold all the bedclothes. The present invention can readily be expanded to accomodate extra layers by the addition of one or more extra straps at each attachment location. FIG. 3 illustrates the use of what will be called an add-on strap 40. The add-on strap 40 is identical in construction to what will hereinafter be called the primary strap 14, shown in FIG. 2, except that the piece of gripping material 42 attached to the strap is of the opposite type. Primary strap 14 has a piece of gripping material 22 with an outer surface coverd with loops for engaging hooks on anchor 24. The add-on strap has a piece of gripping material 42 exactly the same in character and in the means of its attachment, except the outer surface of the piece of hook and loop tape is covered with hooks. Since the gripping surface is of the opposite surface type on the add-on strap 40, compared with primary strap 14, pressing the gripping material 42 of the add-on strap 40 onto the gripping material 22 of primary strap 14, will anchor the add-on strap to the primary strap. This feature permits the addition of an extra bedclothes retainer where needed, with a minimum of tangling of the straps or other inconvenience, since both the primary and add-on straps are anchored at the same location.

Figure 4:
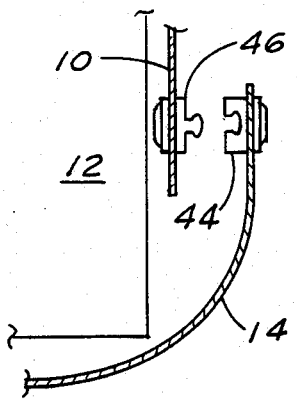
FIG. 4 is another cross-sectional view as in FIG. 3, showing an alternative embodiment bedclothes fastener.

An alternative type of bedclothes fastener can be used with the straps of the present invention. Referring to FIG. 4, strap 14 is provided with the first part 44 of a two part snap fastener in place of clip 20, at one end of the strap. The remainder of the strap of FIG. 4 is the same as the strap of FIG. 2, including the strap material, length adjustment feature and attached piece of gripping material 22. The strap of FIG. 4 is for use with bedclothes which have been provided with the second part 46 of the two part snap fastener at selected locations where attachment is to be effected. This type of attachment would be especially suitable for use with standardized bed linens and blankets at hotels or hospitals. Ball fasteners 46 could be fitted at selected locations on the bedclothes and the cooperating socket 44 on the straps 14 could then be conveniently attached and released, as the bedclothes are changed. The ball and socket fasteners could be used on primary straps together with clip-type fasteners on add-on straps, or vice versa. As such, the bedding and fasteners used could be conveniently tailored for use with standardized sheets and non-standardized blankets, for example.

The present invention provides a convenient and flexible system for holding and positioning bedclothes on a bed. The system is especially suitable for use with modern box spring mattress sets. The anchor gripping pieces are attached with adhesive and can be mounted on wood, metal, or fabric. The straps are installed and removed from the anchor pieces easily and quickly. Of particular importance is the ease with which add-on straps are installed at the same anchor points. The add-on straps permit more bedclothes to be retained with a minimum of tangle and confusion of the straps. Since each add-on strap has an attached gripping piece which is covered on both sides with gripping material of one surface type, another primary strap can be stacked upon and will adhere to the add-on strap, to further increase the capacity of the system. In this manner, primary and add-on straps can be sandwiched in a plurality of layers to anchor a plurality of straps at each anchor point, if desired. The straps securely hold the bedclothes without interfering with the use of the bed. In addition, the straps are adjustable as the size and shape of the bedding in use is changed.

Alternative embodiments are possible within the scope of the invention. For example, alternative types of bedclothes fasteners could be used. Other means of length adjustment will occur to those skilled in the art. The pieces of gripping material could be attached to the straps by means other than an eyelet. The location of the anchor points shown in FIG. 1 is meant to be suggestive only, as is the number of straps used on any individual bed.

What is claimed is:

1. Bedclothes retaining means for holding and positioning bedclothes on a bed, comprising: a plurality of straps formed of flexible ribbon material which stretches elastically in a lengthwise direction, anchoring means for attaching said plurality of straps to the bed at a selected location, said anchoring means including a surface formed of a gripping material of a first type which is detachably attachable to cooperating surfaces formed of gripping material of a second type when said gripping material of said first and second types are pressed together, each said strap including bedclothes fastener means attached to one end of the strap material of said anchoring means and is attached to said first strap along one edge thereof, said anchoring means being attachable to the bed at a selected location such that said first strap is detachably attachable to said anchoring means and said bed by means of said gripping material, and said plurality of straps including a second strap in which the gripping material attached to said other end of said strap is a flexible sheet material having a surface of the other surface type opposite to the surface type of the gripping material attached to said first strap such that said second strap can be detachably attached to said first strap at the location of said gripping material, whereby said plurality of straps can be attached betwee the bedclothes and said anchoring means attached to the bed to hold and position the bedclothes on the bed.

2. Bedclothes retaining means as in claim 1 in which said bedclothes fastener means includes a clip having opposed jaws for gripping bedclothes between said opposed jaws.

3. Bedclothes retaining means as in claim 1 in which said bedclothes fastener means includes a first part of a two part snap fastener attached to each said strap together with bedclothes which include the second part of said two part snap fastener at selected locations where attachment is to be effected.

4. Bedclothes retaining means as in claim 3 in which said two part snap fastener includes a ball on one of said first and second parts and a cooperating socket on the other of said parts.

5. Bedclothes retaining means as in claim 1 in which each said strap includes means for adjusting the length of said strap.

6. Bedclothes retaining means as in claim 1 in which the piece of gripping material is attached to said first strap through an eyelet attached to said strap, said flexible sheet material being elongated tape material having said gripping material of one surface type on one side and adhesive on the other side, said piece of gripping material extending through said eyelet and being doubled over such that the gripping material is on the outside surface.

7. Bedclothes retaining means for holding and positioning bedclothes on a bed, comprising: a plurality of straps formed of flexible ribbon material which stretches elastically in a lengthwise direction, each said strap including bedclothes fastener means attached to one end thereof for gripping and securely holding bedclothes and an eyelet attached to the other end thereof, and including a first piece of gripping material attached to said strap through said eyelet, wherein said gripping material is hook and loop tape having a surface of one of a first and second type which detachably attaches to the opposite surface type when said first and second surface types are pressed together, an anchor piece of said gripping material attachable to the bed at a selected location and having a surface of hook and loop tape of a selected surface type, said plurality of straps including a primary strap in which said first piece of gripping material attached through said eyelet is a piece of said hook and loop tape doubled over to form adjacent lengths of said hook and loop tape having opposed outside surfaces of the surface type opposite the surface type of said anchor piece and an add-on strap in which said first piece of gripping material attached through said eyelet is a length of hook and loop tape having a surface type opposite to the surface type of said first piece of gripping material on said primary strap, said primary strap being detachably attachable to said anchor piece and said add-on strap being detachably attachable to said primary strap at the location of said anchor piece by means of said hook and loop tape, whereby said plurality of straps can be attached between the bedclothes and said anchoring means attached to the bed to hold and position the bedclothes on the bed.

8. Bedclothes retaining means as in claim 7 in which said bedclothes fastener means includes a clip having opposed jaws for gripping bedclothes between said opposed jaws.

9. Bedclothes retaining means as in claim 7 in which said bedclothes fastener means includes a first part of a two part snap fastener attached to each said strap together with bedclothes which include the second part of said two part snap fastener at selected locations where attachment is to be effected.

10. Bedclothes retaining means as in claim 9 in which said two part snap fastener includes a ball on one of said first and second parts and a cooperating socket on the other of said parts.

11. Bedclothes retaining means as in claim 7 in which each said strap includes means for adjusting the length of said strap.

12. Bedclothes retaining means for holding and positioning bedclothes on a bed, copmrising: a strap formed of flexible ribbon material which stretches elastically in a lengthwise direction, said strap having a eyelet attached to one end thereof and a first piece of gripping material attached thereto through said eyelet, said gripping material being hook and loop tape having a surface of one of a first and second type which detachably attached to the opposite surface type when said first and second surface types are pressed together, said hook and loop tape being formed of flexible sheet material covered on one side with a gripping surface of one said surface type and on the other side with adhesive, said first piece of gripping material being a piece of hook and loop tape extending through said eyelet and being doubled over with the gripping surface on the outside whereby an additional strap attached to a piece of hook and loop tape of the opposite surface type can be attached to the doubled over piece of hook and loop tape, said strap including a clip having opposed jaws attached to the other end thereof for gripping and securely holding bedclothes, and a second piece of gripping material having a gripping surface of the type opposite to the gripping surface of the hook and loop tape attached to the strap, said second piece of gripping material being attachable to the bed at a selected location where the strap is to be anchored, whereby said strap is attachable to the bedclothes by means of said clip and to the bed by means of said first and second pieces of gripping material to hold and position bedclothes on the bed.

13. Bedclothes retaining means as in claim 12 in which said strap further includes a first part of a two part snap fastener attached to said strap at said other end together with bedclothes which include the second part of said two part snap fastener at selected locations where attachment is to be effected.

14. Bedclothes retaining means as in claim 13 in which said two part snap fastener includes a ball on one of said first and second parts and a cooperating socket on the other of said parts.

15. Bedclothes retaining means as in claim 12 in which each said strap includes means for adjusting the length of said strap.

* * * * *